US007178256B2

(12) United States Patent
Roche

(10) Patent No.: US 7,178,256 B2
(45) Date of Patent: Feb. 20, 2007

(54) HOOP ANGLE FINDER

(75) Inventor: Eileen Katherine Roche, Flower Mound, TX (US)

(73) Assignee: Great Notions News Corporation, Dallas, TX (US)

( * ) Notice: Subject to any disclaimer, the term of this patent is extended or adjusted under 35 U.S.C. 154(b) by 0 days.

(21) Appl. No.: 11/152,297

(22) Filed: Jun. 14, 2005

(65) Prior Publication Data

US 2006/0277780 A1 Dec. 14, 2006

(51) Int. Cl.
*A41H 3/015* (2006.01)

(52) U.S. Cl. ..... 33/653

(58) Field of Classification Search ..... 33/653
See application file for complete search history.

(56) References Cited

U.S. PATENT DOCUMENTS

| | | | | | |
|---|---|---|---|---|---|
| 3,813,783 | A * | 6/1974 | Price | 33/1 SD |
| 4,302,884 | A * | 12/1981 | Pallone | 33/653 |
| 4,625,409 | A * | 12/1986 | Arakawa | 33/471 |
| 4,762,076 | A | 8/1988 | Wakaizumi | 112/103 |
| 4,774,778 | A | 10/1988 | Williams | 38/102.2 |
| 5,144,899 | A | 9/1992 | Allen | 112/103 |
| 5,842,430 | A | 12/1998 | Mack | 112/103 |
| 5,865,133 | A | 2/1999 | Herbach et al. | 112/475.19 |
| 5,915,315 | A | 6/1999 | Bentz | 112/103 |
| 5,970,895 | A | 10/1999 | Mack | 112/103 |
| 5,992,339 | A | 11/1999 | Mack | 112/103 |
| 6,131,620 | A * | 10/2000 | Mette | 33/653 |
| 6,240,864 | B1 | 6/2001 | Pettigrew et al. | 112/475.18 |
| 6,691,631 | B2 | 2/2004 | Pettigrew et al. | 112/475.18 |
| 6,775,934 | B1 | 8/2004 | Gallik et al. | 38/102.2 |
| 6,832,569 | B2 | 12/2004 | Krasnitz | 112/475.18 |
| 2001/0042497 | A1 | 11/2001 | Pettigrew et al. | 112/475.18 |
| 2002/0189517 | A1 | 12/2002 | Pettigrew et al. | 112/475.19 |
| 2004/0154512 | A1 | 8/2004 | Krasnitz | 112/475.18 |

* cited by examiner

*Primary Examiner*—Christopher W. Fulton
(74) *Attorney, Agent, or Firm*—Duke W. Yee; Cathrine K. Kinslow

(57) ABSTRACT

An angle finder tool for use with embroidery machines, wherein the tool enables accurate angle measurements to be determined so that the embroidery machine may properly orient the design onto the fabric during the embroidery process. The angle finder tool includes a lower component comprising an angle degree chart and an upper component connected to the lower component, wherein the upper component comprises a crosshair. The upper component rotates independently of the lower component. The angle finder tool is placed within and parallel to an embroidery hoop and centered on a target orientation indicator on the fabric. The crosshair on the upper component is rotated to align with an arrow on the target indicator. The angle indicated by aligning the crosshair and target indicator arrow is supplied to an embroidery machine, which uses the angle to orient a design template in relation to the fabric.

11 Claims, 6 Drawing Sheets

HOOP ANGLE FINDER

BACKGROUND OF THE INVENTION

1. Field of the Invention

The present invention relates generally to embroidery systems, and in particular, to an angle finder tool for determining accurate embroidery angle measurements.

2. Description of the Related Art

In the current art, embroidery designs may be used as templates for embroidering a design onto fabric. Embroidery designs are employed by an embroidery/sewing machine to guide the machine's movement of the embroidery arm. The embroidery arm is directed to stitch the same pattern specified in the design.

An embroidery hoop is used to hold the stabilizer material and the fabric together, so that the design may be embroidered in the desired location and position on the underlying fabric. However, in some instances, the designs may be very large, and thus may not fit within a user's embroidery hoop. For example, FIG. 1 illustrates an embroidery design that does not fit within an available embroidery hoop. In this situation, the large design may be partitioned into multiple smaller design templates or sections 102–110. By partitioning sections of the large design, these smaller design templates may now fit within the user's embroidery hoop. Each of smaller design sections 102–110 may then be embroidered onto fabric 112 using the user's hoop.

However, alignment may be a problem when orienting a design template to the fabric, as well as to other design sections. Currently, if a user wants to align a design template to a desired position, the user must currently orient the design by essentially "eyeballing" the angle in which the design template should be placed against the fabric. Once the estimated orientation angle is determined, the user may then provide this estimated angle to the embroidery machine. The embroidery machine uses the user-provided angle to orient the embroidery to the design on the fabric. As the angle provided to the embroidery machine is a user-determined and estimated angle, the angle determined by a user may be inaccurate.

Thus, it would be advantageous to have a mechanism for finding a more accurate angle measurement for use in properly orienting the design onto the fabric during the embroidery process.

SUMMARY OF THE INVENTION

The present invention provides an angle finder tool for use with embroidery machines. The mechanism of the present invention allows for determining an accurate angle measurement so that the embroidery machine may properly orient the design onto the fabric during the embroidery process. The angle finder tool includes a lower component comprising an angle degree chart and an upper component connected to the lower component, wherein the upper component comprises a crosshair. The upper component rotates independently of the lower component. The angle finder tool is placed within and parallel to an embroidery hoop and centered on a target orientation indicator on the fabric. The crosshair on the upper component is rotated to align with an arrow on the target indicator. The angle indicated by alignment of the crosshair and the arrow on the target orientation indicator is supplied to an embroidery machine, which uses the angle to orient a design template in relation to the fabric.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE PREFERRED EMBODIMENT

The present invention provides an angle finder tool for use with embroidery machines. In an illustrative example, the angle finder tool comprises an upper and lower component connected together. The lower component of the angle finder tool comprises an angle degree chart, preferably comprising 360 degrees. The upper component of the angle finder tool comprises cross hairs, the cross hairs being preferably in a contrasting color or line pattern from the color or line pattern of the angle degree chart.

Figure 1:
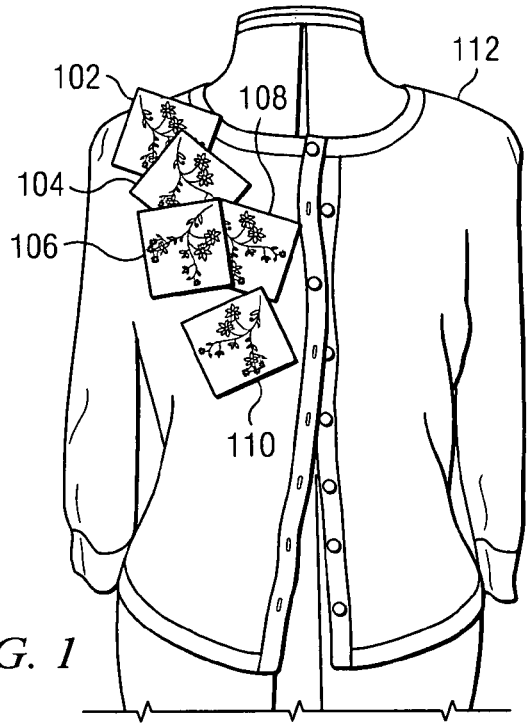
FIG. 1 depicts a design template partitioned into multiple design template sections and placed on an underlying fabric.
Figure 2:
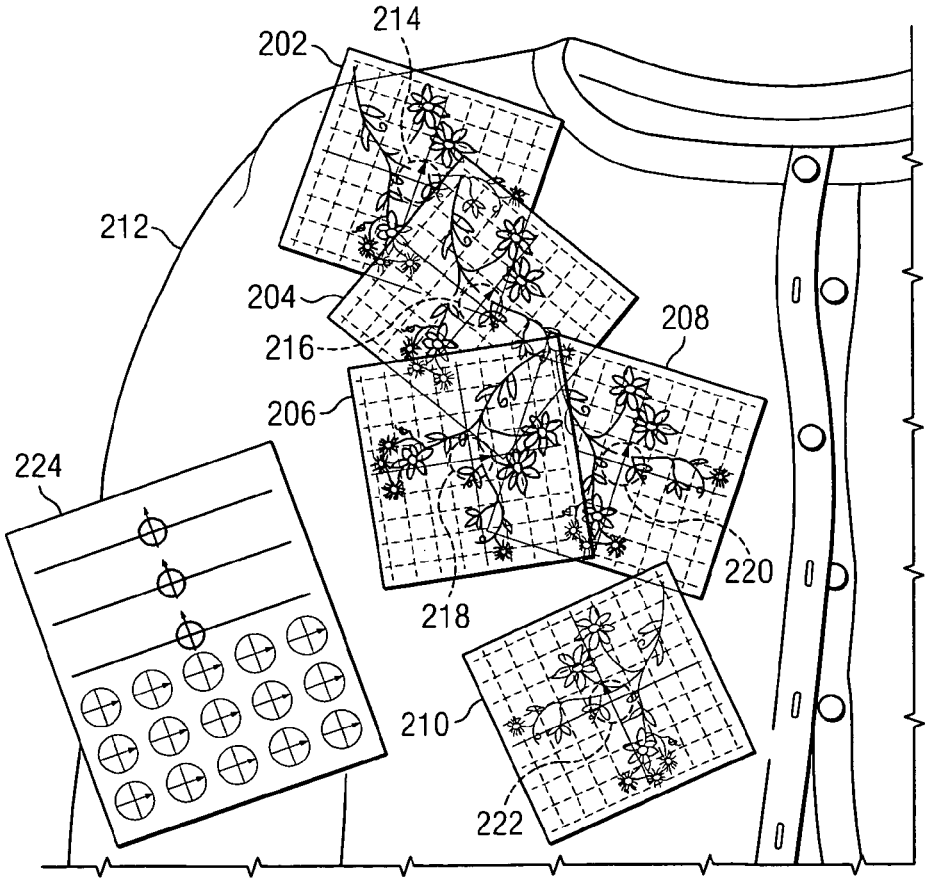
FIG. 2 illustrates multiple design template sections and corresponding target indicators in accordance with an illustrative embodiment of the present invention.

FIG. 2 depicts an embroidery design that has been partitioned into multiple smaller design sections 202–210 and their corresponding target indicators in accordance with an illustrative embodiment of the present invention. Design sections 202–210 may be taped in place onto fabric 212. Although the example in FIG. 2 illustrates a larger design sectioned into multiple smaller designs, the mechanism of the present invention may be used to provide accurate angle measurements for a single embroidery design template, as well as for multiple design templates which are part of a larger design.

Figure 3:
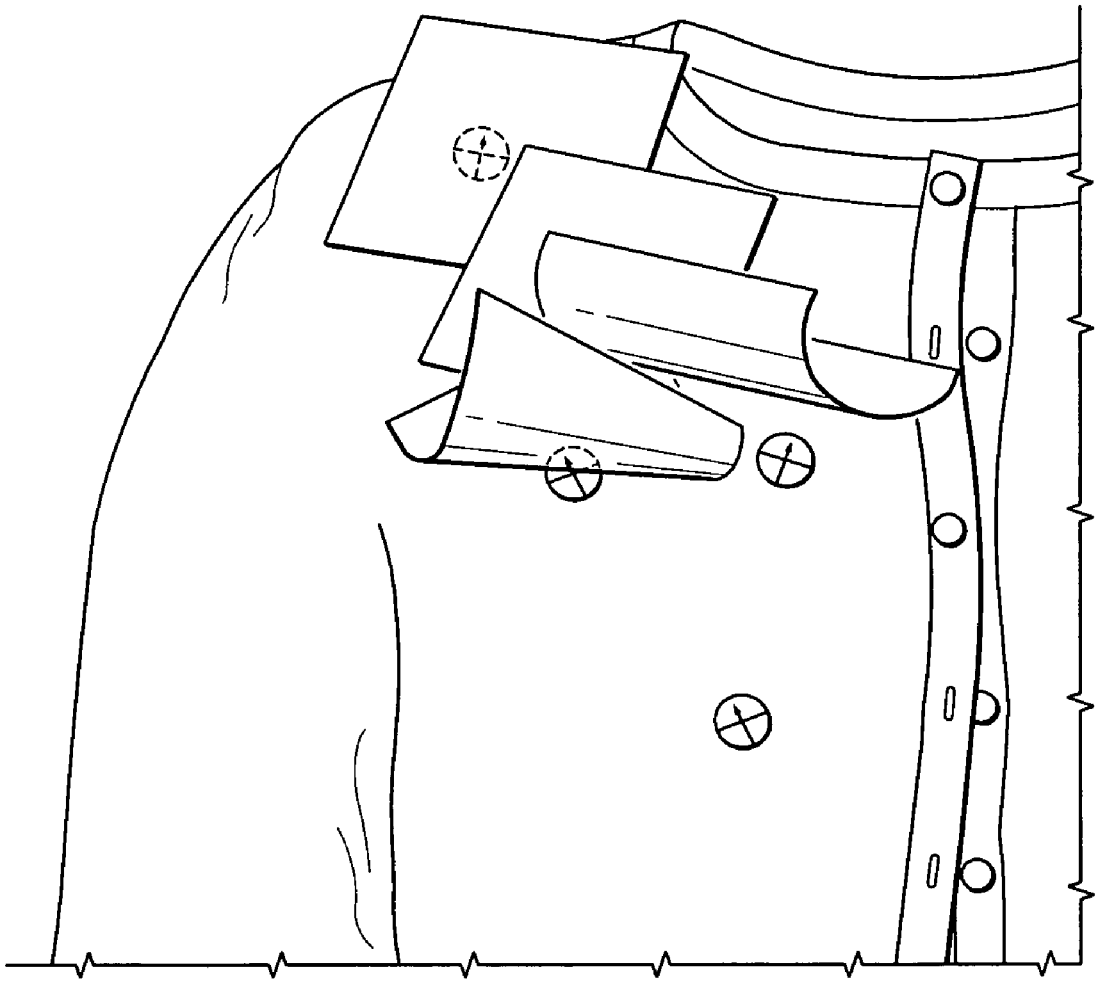
FIG. 3 illustrates the removal of the design templates once the target indicators for the design templates have been placed on the fabric in accordance with an illustrative embodiment of the present invention.

Each design section 202–210 comprises a component of the original large design template. To determine an accurate angle measurement to allow an embroidery machine to properly orient the design template onto fabric 212 and to other designs as well, a target orientation indicator, such as target indicators 214–222, is used to indicate the proper orientation of the embroidery design. A target indicator comprises an arrow which indicates the top edge of the design. For instance, all lettering in the design appears as it should read. Rotating a letter rotates the baseline of the letter. The target indicator is used to designate the orientation of the design in relation to the fabric and, if present, other embroidery designs. In this illustrative example, target indicators are obtained from a target indicator sheet 224, which contains multiple target indicators. These target indicators may contain adhesive on one side to allow the target indicator to adhere to the fabric. A user may place a target indicator from target indicator sheet 224 under a design template and onto the fabric to indicate the orientation of the design. In alternative embodiments, embroiderers may draw alignment crosshairs on the fabric using chalk, pencil, removable marker, or pins. An embroiderer may also use two pressed creases for an alignment crosshair, which is most often used when embroidering a single design in the center of an item, such as a pillow, quilt block, towel, and the like. Once the target indicators for the design templates have been positioned on the fabric, the design templates may be removed, as shown in FIG. 3. Thus, at this point, only the target indicators are present on the fabric.

Figure 4:
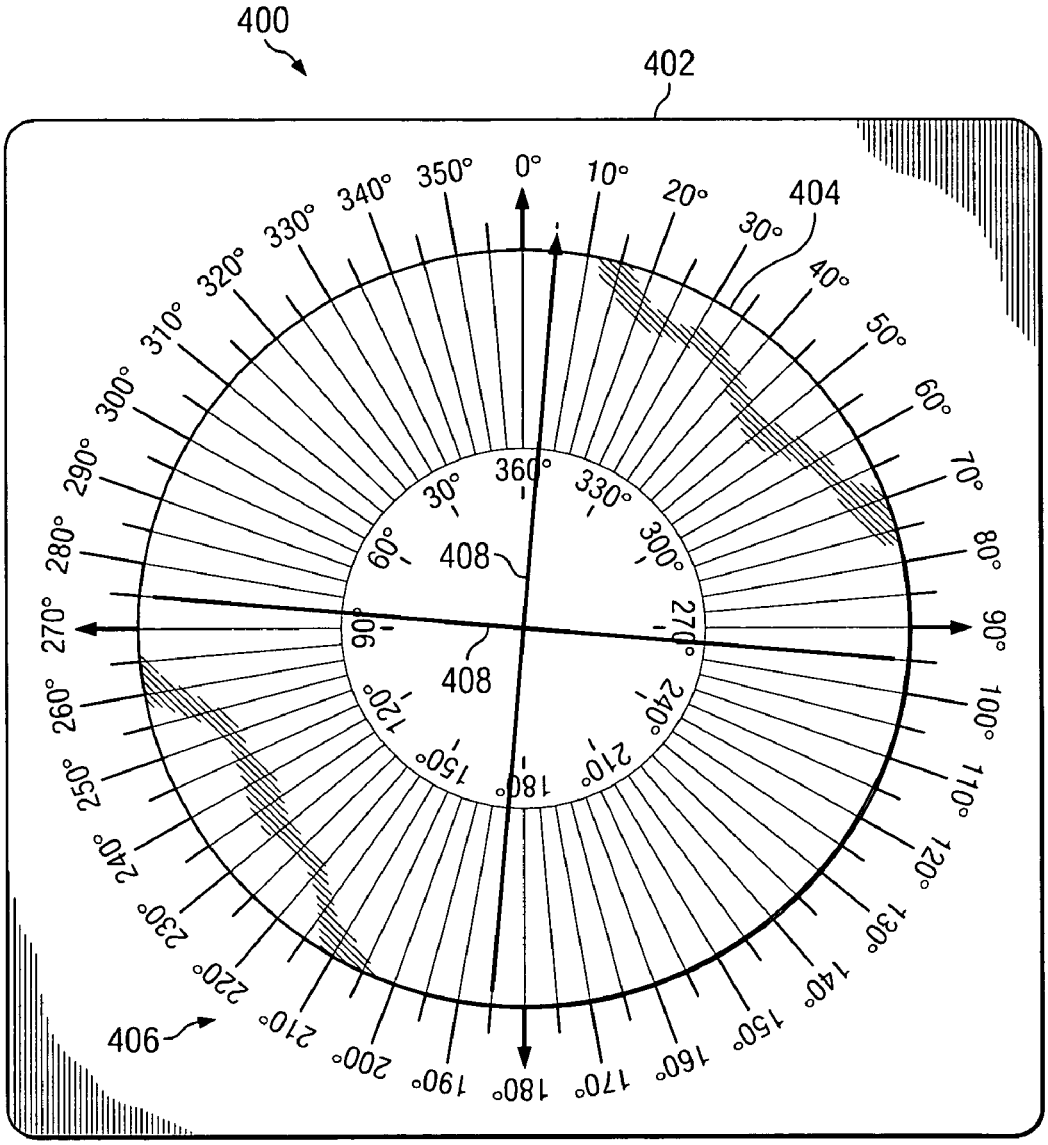
FIG. 4 illustrates an angle finder tool in accordance with an illustrative embodiment of the present invention.

Turning next to FIG. 4, an angle finder tool in accordance with an illustrative embodiment of the present invention is shown. In this illustrative example, angle finder tool 400 is shown to be comprised of two components, lower component 402 and upper component 404, connected together. Although lower component 402 is shown to have a rectangular shape and upper component 404 is shown to have a circular shape, the present invention is not limited to these particular shape configurations. Lower component 402 and upper component 404 may be connected together using any known fastening means. Regardless of the particular fastening means used, upper component 404 of angle finder tool 400 should be able to rotate independently of lower component 402.

Lower component 404 of angle finder tool 400 comprises angle degree chart 406. In a preferred embodiment, angle degree chart 406 comprises 360 degrees. Upper component 404 of angle finder tool 400 comprises cross hairs 408. The shape of upper component 402 is such that the angle degree chart 406 in lower component 402 is visible to a user while the upper component is positioned on top of the lower component. In a preferred embodiment, cross hairs 408 are comprised of colors or line patterns in contrast from the colors or line patterns present in the angle degree chart.

Figure 5:
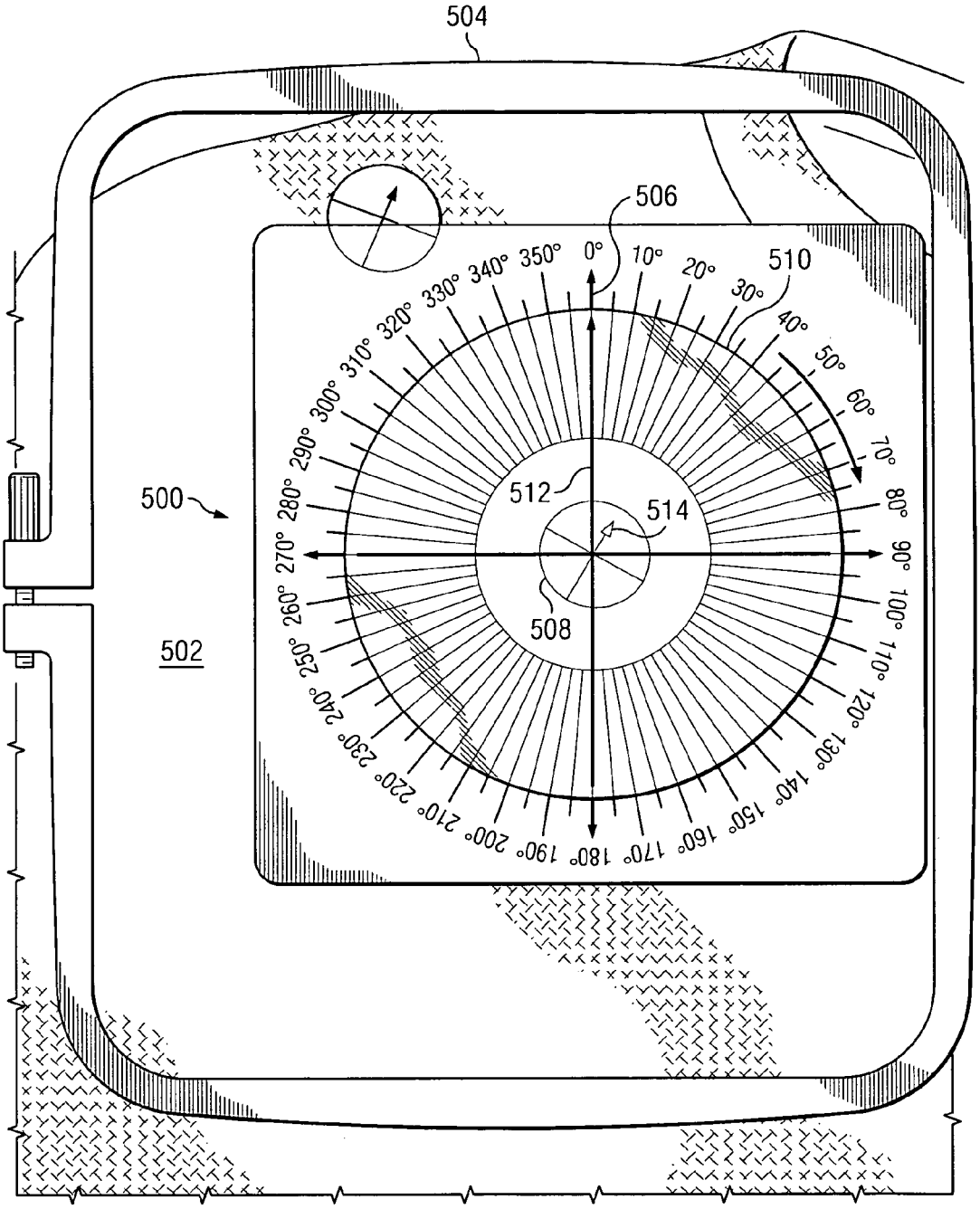
FIG. 5 illustrates how an angle finder tool is placed on fabric when the fabric is hooped in accordance with an illustrative embodiment of the present invention.

FIG. 5 illustrates how the angle finder tool may be placed on fabric when the fabric is hooped in accordance with an illustrative embodiment of the present invention. When angle finder tool 500 is placed onto fabric 502, the tool is positioned so that the edges of the tool are parallel to the edges of embroidery hoop 504. For example, crosshair 506 of lower component of angle finder tool 500 is parallel to the hoop's edges. The tool is placed parallel to the hoop edge so that the lower component's 0° points to the upper edge of the hoop. Since all embroidery designs are originally oriented in this position (i.e., the starting position), keeping the lower component parallel to the hoop's edge actually keeps the 0° in the proper position. If the lower component is rotated out of the parallel position, the upper component may provide a false reading. In addition, angle finder tool 500 is also centered over a target indicator, such as target indicator 508. In a preferred embodiment, the upper and lower components of the angle finder tool are transparent, such that target indicator 508 is visible through the upper and lower components of the angle finder tool. For example, angle finder tool 500 may be comprised of transparent glass or plastic. Once the angle finder tool is properly positioned parallel to the edges of the hoop and centered on a target indicator, the upper component of the alignment measurement tool may be rotated to align the cross hairs on the upper component with the arrow on the target indicator. For example, upper component 510 is rotated such that cross hair 512 is aligned with arrow 514 on target indicator 508.

Figure 6:
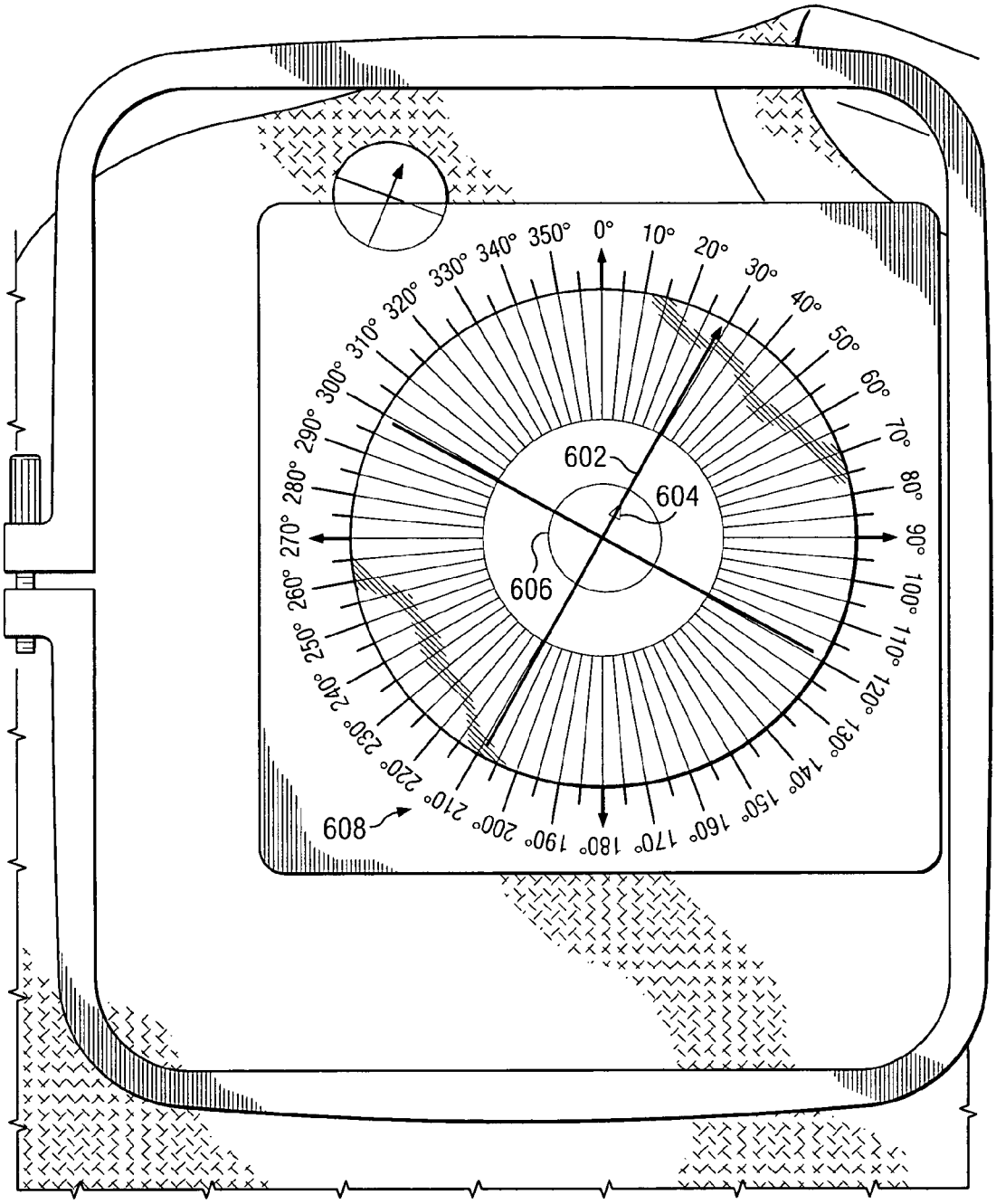
FIG. 6 illustrates the rotating the angle finder tool to find an angle measurement in FIG. 5 in accordance with an illustrative embodiment of the present invention.

FIG. 6 shows a result of rotating the angle finder tool in FIG. 5 in accordance with an illustrative embodiment of the present invention. In this illustrative example, the upper component of the angle finder tool has been rotated to where cross hair 602 is now aligned with arrow 604 on target indicator 606. As shown, cross hair 602 now points to an angle measurement on angle degree chart 608. The user may determine the angle measurement of the design (in this example, 29°) and supply this angle measurement to the embroidery machine.

Figure 7:
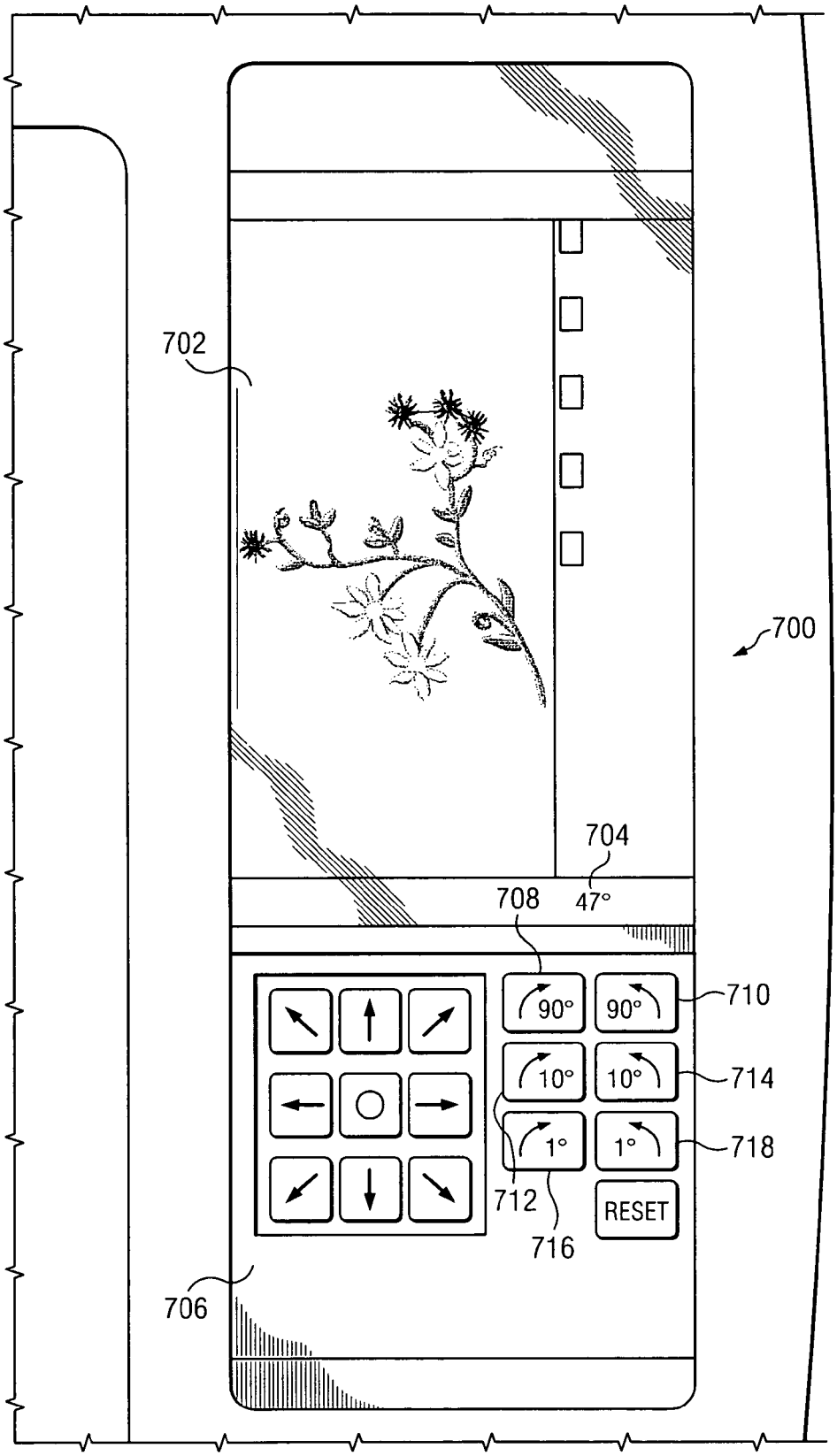
FIG. 7 illustrates an embroidery machine monitor panel in accordance with an illustrative embodiment of the present invention.

FIG. 7 illustrates an embroidery machine monitor panel in accordance with an illustrative embodiment of the present invention. The user may input angle measurement information found using the angle finder tool as described in FIG. 6 to the embroidery machine through the monitor panel.

In this illustrative example, embroidery machine monitor panel 700 comprises angle input screen 702. Angle input screen 702 comprises the current angle 704 of an embroidery design (in this example, 47°) and keypad 706. Keypad 706 may be used to adjust current angle 704 shown on angle input screen 702. For example, the user may select to rotate the design by 90° to the right or left (708 and 710, respectively), 100 to the right or left (712 and 714, respectively), or 1° to the right or left (716 and 718, respectively). Likewise, the user may use keypad 706 to move the design within the sewing field (hoop) without rotating the design. These movements may include right/left and up/down movements in small increments, such as millimeters. Movement may be limited by the size of the attached hoop.

Current angle 704 should be adjusted to reflect the angle measurement that was found using the angle finder tool as described in FIG. 6. By updating the current angle of the embroidery machine with the angle found with the angle finder tool, the machine may properly orient the design onto the fabric during the embroidery process. In this manner, the invention allows for providing a more accurate angle measurement to the embroidery machine than existing methods.

Once the current angle on the angle input screen has been updated with the angle measurement found using the angle finder tool, the embroidery machine may then embroider the design onto the fabric. This process of identifying the angle measurement may be repeated for each design.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. An angle finder tool used to determine proper orientation of an embroidery design in relation to a fabric, comprising:

a lower component comprising an angle degree chart; and a single upper component connected to the lower component, wherein the upper component comprises a crosshair;

wherein the upper component rotates independently of the lower component, wherein the angle finder tool is placed within and parallel to an embroidery hoop and centered on a target orientation indicator on the fabric, wherein the crosshair on the upper component is rotated to align with an arrow on the target orientation indicator, and wherein an angle indicated by alignment of the crosshair and the arrow on the target orientation indicator is used to orient a design template in relation to the fabric.

2. The angle finder tool of claim 1, wherein the angle is provided to an embroidery machine, wherein the embroidery machine uses the angle to orient embroidery of a design on the fabric.

3. The angle finder tool of claim 1, wherein the angle indicated by alignment of the crosshair and the arrow on the target orientation indicator is used to orient a design template in relation to one or more additional design templates.

4. The angle finder tool of claim 1, wherein the crosshair in the upper component comprises a color contrasting with the color present in the angle degree chart.

5. The angle finder tool of claim 1, wherein the crosshair in the upper component comprises a line pattern contrasting with the line pattern present in the angle degree chart.

6. The angle finder tool of claim 1, wherein the placement of the angle finder tool within an embroidery hoop on the fabric comprises placing an edge of the lower component parallel to an edge of the embroidery hoop to facilitate orienting the design template in relation to the fabric.

7. A method for finding an angle of orientation of an embroidery design in relation to fabric, comprising:

placing a design template onto the fabric;

placing a target orientation indicator on the fabric under the design template;

removing the design template;

hooping the fabric;

determining the angle of orientation of the embroidery design in relation to the fabric, wherein the angle of orientation is determined using an angle finder tool having a lower component comprising an angle degree chart connected to an upper component comprising a crosshair;

placing the angle finder tool within an embroidery hoop on the fabric, wherein the angle finder tool is placed parallel to sides of the embroidery hoop and centered on a target orientation indicator on the fabric;

rotating the crosshair on the upper component to align with an arrow on the target orientation indicator; and identifying an angle on the lower component to which the crosshair points when aligned with the target orientation indicator, wherein the angle is used by an embroidery machine to orient a design template in relation to the fabric.

8. The method of claim 7, further comprising:

supplying the angle to the embroidery machine.

9. The method of claim 7, wherein the angle indicated by alignment of the crosshair and the arrow on the target orientation indicator is used to orient the design template in relation to one or more additional design templates.

10. The method of claim 7, wherein the crosshair comprises a color contrasting with the color present in the angle degree chart.

11. The method of claim 7, wherein the crosshair the upper component comprises a line pattern contrasting with the line pattern present in the angle degree chart.

* * * * *